US011381894B2

(12) United States Patent
Lee et al.

(10) Patent No.: US 11,381,894 B2
(45) Date of Patent: Jul. 5, 2022

(54) DEVICE WITH LINEAR SLOTS FOR WATER DRAINAGE

(71) Applicant: MOTOROLA SOLUTIONS, INC., Chicago, IL (US)

(72) Inventors: Geng Xiang Lee, Bayan Lepas (MY); Chi T. Tran, Chicago, IL (US); Charles B. Harmke, Chicago, IL (US); Ji Ying Choong, Bayan Lepas (MY); Kuang Eng Lim, Bayan Lepas (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 48 days.

(21) Appl. No.: 16/985,748

(22) Filed: Aug. 5, 2020

(65) Prior Publication Data

US 2022/0046346 A1 Feb. 10, 2022

(51) Int. Cl.

| | |
|---|---|
| ***H04R 1/02*** | (2006.01) |
| ***H04R 1/08*** | (2006.01) |
| ***H04R 1/28*** | (2006.01) |

(52) U.S. Cl.

CPC ..... *H04R 1/025* (2013.01); *H04R 1/083* (2013.01); *H04R 1/2888* (2013.01); *H04R 2499/11* (2013.01)

(58) Field of Classification Search

CPC ..... H04R 1/025; H04R 1/083; H04R 1/2888; H04R 2499/11

See application file for complete search history.

(56) References Cited

U.S. PATENT DOCUMENTS

| | | | | |
|---|---|---|---|---|
| 4,032,844 | A * | 6/1977 | Imazeki | H04B 1/3822 455/92 |
| 7,668,332 | B2 | 3/2010 | Williams et al. | |
| 8,157,048 | B2 * | 4/2012 | Banter | H04R 1/023 381/189 |
| 9,609,411 | B2 | 3/2017 | Parkins | |
| 9,877,097 | B2 | 1/2018 | Saw et al. | |
| 2004/0120541 | A1 * | 6/2004 | Maekawa | H04R 1/025 381/87 |

(Continued)

FOREIGN PATENT DOCUMENTS

WO 2020131328 A1 6/2020

OTHER PUBLICATIONS

PCT/US2021/042382, Device With Linear Slots for Water Drainage, filed Jul. 20, 2021.

*Primary Examiner* — Oyesola C Ojo
(74) *Attorney, Agent, or Firm* — Perry + Currier, Inc.

(57) ABSTRACT

A device with linear slots for water drainage is provided. The device comprises: a bezel covering a cavity and a microphone/speaker mounted therein, the bezel having outer and inner faces, the inner face facing the cavity; linear slots through the bezel between the faces, the linear slots being obliquely angled relative to an upright axis of the bezel; linear slats separating the linear slots at the bezel and forming sides thereof having dimensions selected to promote formation of water droplets thereon of a size which overcome water surface tension and flow out of the linear slots when the bezel is exposed to one or more of mist, rain, water and humidity; and one or more recesses at the inner face, adjacent to the linear slots, the one or more recesses to collect water from the water droplets as the water flows out of the linear slots.

19 Claims, 5 Drawing Sheets

(56) References Cited

U.S. PATENT DOCUMENTS

| | | | | |
|---|---|---|---|---|
| 2006/0177089 | A1* | 8/2006 | Greco | H04R 1/023 381/391 |
| 2011/0103634 | A1 | 5/2011 | Maddern et al. | |
| 2013/0028464 | A1* | 1/2013 | Hayashi | H04R 1/023 381/391 |
| 2016/0277818 | A1* | 9/2016 | Jones | H04R 1/023 |
| 2020/0204894 | A1 | 6/2020 | Harmke et al. | |

* cited by examiner

DEVICE WITH LINEAR SLOTS FOR WATER DRAINAGE

BACKGROUND OF THE INVENTION

Some portable devices, such as remote speaker microphones (RSMs), and the like, are often exposed to water, such as rain, water spray, mist and the like, which can get into microphone and/or speaker cavities, and the like, of the portable devices, and block and/or degrade the microphones and/or speakers.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
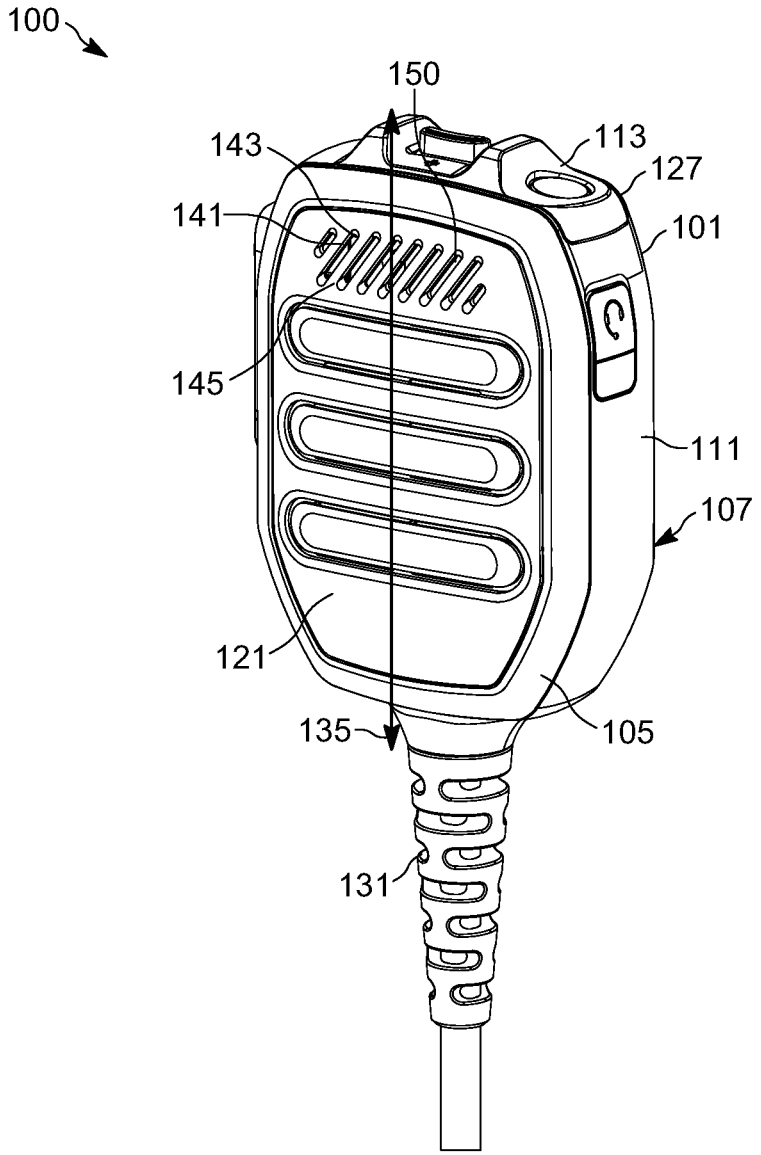
FIG. 1 is a perspective view of a device with linear slots for water drainage, in accordance with some examples.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Some portable devices, such as remote speaker microphones (RSMs), and the like, are often exposed to water, such as rain, water spray, mist and the like, which can get into microphone and/or speaker cavities, and the like, via microphone and/or speaker ports of the portable devices, and block and/or damage microphones and/or speakers. Such blockage and/or damage can cause the microphone and/or speakers to operate poorly, which may cause unintelligible speech either at the device (e.g. from a speaker) or in audio transmitted by the device (e.g. as received at a microphone). An ancillary issue may be wind noise which occurs due to the Helmholtz effect when wind blows across the microphone and/or speaker ports.

Some solutions to prevent water damage and/or wind noise include a grille, and the like, between the ports and the cavity, and/or using sneak paths between the ports and the cavity. However, such solutions may result in increased cost and/or complexity of the device, and/or in a reduced wide-band response of the microphone and/or the speaker (e.g. as compared to devices which lack a grille and/or a sneak path).

Hence, provided herein is a device that includes a microphone and/or a speaker in a cavity, with oblique linear slots in a bezel covering the cavity (e.g. oblique relative to an upright axis of the bezel and/or the device, and/or relative to top and bottom surfaces of a housing and/or the device). The linear slots may be separated by linear slats which form sides of the linear slots. Dimensions of the linear slats, and/or dimensions of sides of the linear slots and/or dimensions of the linear slots, including a thickness thereof, are selected to promote water droplet formation at the sides of the linear slots, for example due to a capillary effect. Put another way, dimensions of the linear slots are selected to promote formation of water droplets at the sides of the linear slots and/or in the linear slots, which are of a size which overcome water surface tension and flow out of the linear slots when the bezel is exposed to one or more of mist, rain, water and humidity, for example in operation and/or during mist and/or dunk testing. The device is also provided with at least one recess at an inner face of the bezel, adjacent the linear slots, which collect water from the water droplets as they flow out of the linear slots. In some examples, the device is further provided with at least one drainage channel connected to the at least one recess to provide a path for water in the at least one recess to drain out of the device. Furthermore, the dimensions of the linear slots may be selected, in combination with a given volume of the cavity, to reduce Helmholtz resonance within a given transmission band.

An aspect of the specification provides a device comprising: a cavity; one or more of a microphone and a speaker mounted in the cavity; a bezel covering the cavity and the one or more of the microphone and the speaker, the bezel having an outer face and an inner face, the inner face facing the cavity; linear slots through the bezel from the outer face to the inner face, the linear slots being obliquely angled relative to an upright axis of the bezel; linear slats separating the linear slots at the bezel and forming sides thereof having dimensions selected to promote formation of water droplets thereon of a size which overcome water surface tension and flow out of the linear slots when the bezel is exposed to one or more of mist, rain, water and humidity; and one or more recesses at the inner face of the bezel, adjacent to the linear slots, the one or more recesses to collect water from the water droplets as the water flows out of the linear slots.

Another aspect of the specification provides portable communication device comprising: a housing having a cavity formed therein, the housing having a front surface, a back surface, a first side surface and a second side surface, and a top surface and a bottom surface; one or more of a microphone and a speaker mounted in the cavity; a bezel formed as part of the front surface of the housing, the bezel covering the cavity and the one or more of the microphone and the speaker, the bezel having an outer face, coincident with the front surface of the housing, and an inner face, the inner face facing the cavity; linear slots through the bezel from the outer face to the inner face, the linear slots being obliquely angled relative to the first side surface and the second side surface of the housing, and relative to the top surface and the bottom surface of the housing; linear slats separating the linear slots at the bezel and forming sides thereof, at least the sides providing a platform for formation of water droplets when the bezel is exposed to one or more of mist, rain, water and humidity, the linear slots providing for removal of the water droplets when a surface tension of the water droplets formed on the platform is reached; and one or more recesses at the inner face of the bezel, adjacent to the linear slots, the one or more recesses to collect water from the water droplets as the water flows out of the linear slots.

Another aspect of the specification provides portable communication device comprising: a housing having a cavity formed therein, the housing having a front surface, a back surface, a first side surface and a second side surface, and a top surface and a bottom surface; one or more of a microphone and a speaker mounted in the cavity; a bezel formed as part of the front surface of the housing, the bezel covering the cavity and the one or more of the microphone and the speaker, the bezel having an outer face, coincident with the front surface of the housing, and an inner face, the inner face facing the cavity; one or more linear slots through the bezel from the outer face to the inner face, the one or more linear slots being obliquely angled relative to the first side surface and the second side surface of the housing, and relative to the top surface and the bottom surface of the housing, the one or more linear slots having sides providing a platform for formation of water droplets when the bezel is exposed to one or more of mist, rain, water and humidity, the linear slots providing for removal of the water droplets when a surface tension of the water droplets formed on the platform is reached; and one or more recesses at the inner face of the bezel, adjacent to the linear slots, the one or more recesses to collect water from the water droplets as the water flows out of the linear slots.

Attention is directed to FIG. 1 which depicts a perspective view of a device 100 with linear slots for water drainage, in accordance with some examples. As depicted the device 100 comprises a remote speaker microphone (and/or a radio speaker microphone), however the device 100 may comprise any suitable device and/or portable communication device with linear slots for water drainage, as described hereafter. In some examples, the device 100 may comprise a body wearable device (such as an RSM and/or another body wearable device). In particular examples, the device 100 may comprise a shoulder mountable wearable device (such as an RSM and/or another shoulder mountable wearable device).

However, the device 100 may include any suitable device that includes a microphone and/or speaker in a cavity that may be adapted to include linear slots for water drainage, as described hereafter, including, but not limited to, a cell phone, a radio device, a laptop computer, and the like.

Figure 2:
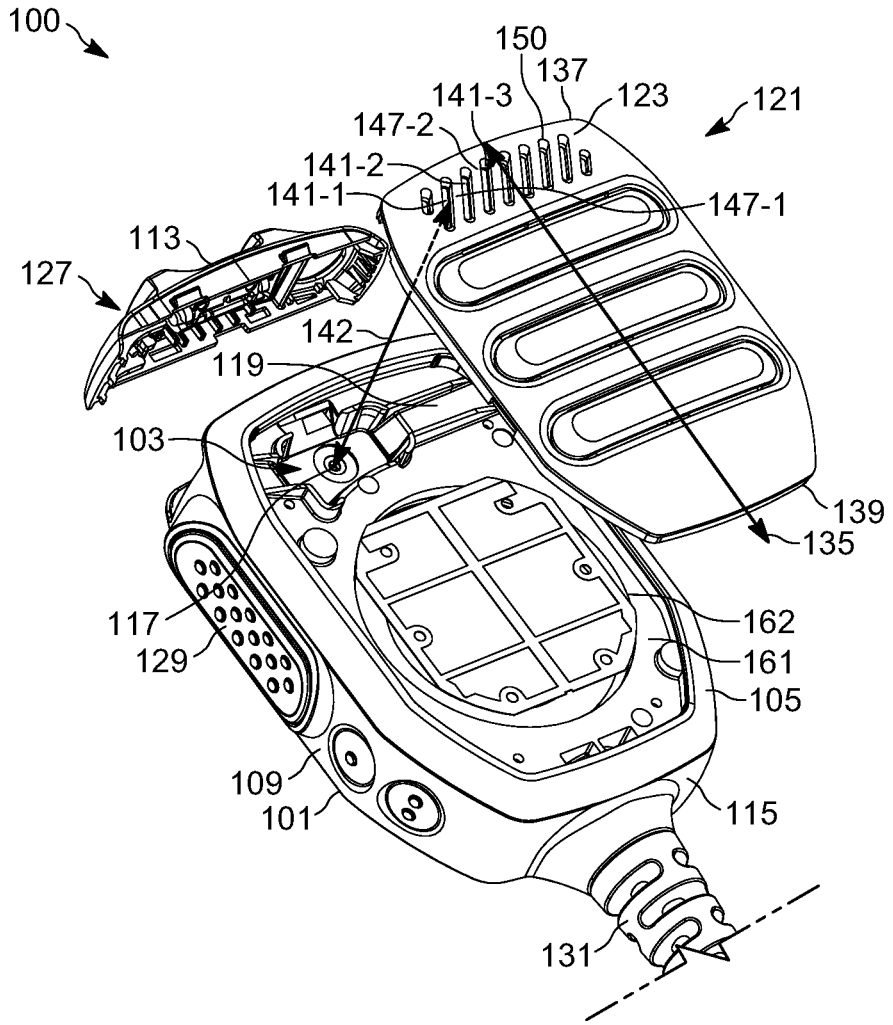
FIG. 2 depicts a perspective view of the device of FIG. 1 partially disassembled to show a microphone cavity, in accordance with some examples.
Figure 3:
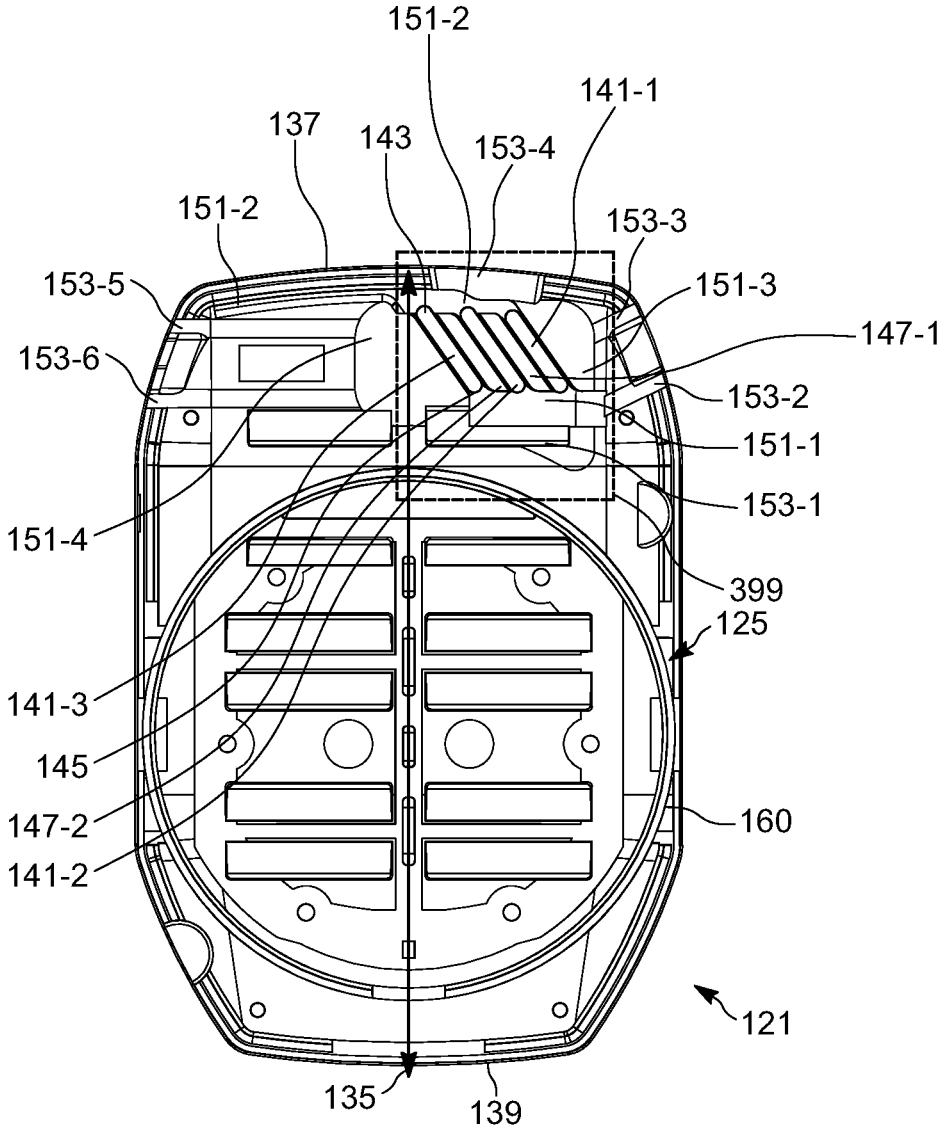
FIG. 3 depicts an inner face of a bezel of the device of FIG. 1, in accordance with some examples.

The device 100 will next be described in more detail with reference to FIG. 1, FIG. 2, and FIG. 3. FIG. 1 depicts a perspective view of the device 100, FIG. 2 depicts a perspective view of the device 100 in a partially disassembled state, and FIG. 3 depicts an inner face of a bezel of the device 100. Comparing FIG. 1 and FIG. 2, it is understood that the perspective thereof differ to show various sides of a housing thereof.

With reference first to FIG. 1 and FIG. 2, the device 100 generally comprises a housing 101 having a cavity 103 formed therein, the housing 101 having a front surface 105, a back surface 107 (e.g. not strictly visible in FIG. 1 or FIG. 2 but understood to oppose the front surface 107 as indicated in FIG. 1), a first side surface 109 (e.g. a left side surface) and a second side surface 111 (e.g. a right side surface), and a top surface 113 and a bottom surface 115. In general, the surfaces 105, 107 oppose each other, the surfaces 109, 111 oppose each other, and the surfaces 113, 115 oppose each other. Furthermore, the surfaces 109, 111, 113, 115 form a perimeter of the device 100 and/or the housing 101, with the surfaces 109, 111 joining the surfaces 113, 115, and vice versa. The surfaces 109, 111, 113, 115 further join the surfaces 105, 107.

The device 100 further includes one or more of a microphone and a speaker mounted in the cavity 103. While hereafter, the device 100 is described with respect to a microphone 117 mounted in the cavity 103, it is understood that the microphone 117 may be replaced with a speaker and/or a speaker may be mounted in the cavity 103 with the microphone 117 and/or the microphone 117 may comprise a combined speaker/microphone. The cavity 103 may have any suitable shape (which, as depicted, may include a secondary cavity 119).

The device 100 generally includes a bezel 121 covering the cavity 103 and the microphone 117, the bezel 121 having an outer face 123 (as best seen in FIG. 2) and an inner face 125 (as best seen in FIG. 2), the inner face 125 facing the cavity 103 (e.g. when the device 100 is assembled).

The bezel 121 may be formed as part of the front surface 105 of the housing 101 (e.g. as depicted in FIG. 1), and/or the bezel 121 may be removeable from the housing 101 (e.g. as depicted in FIG. 2). Hence, the bezel 121 may further be configured to mate with the housing 101 (e.g. at the front surface 105), for example via any suitable mating mechanism (e.g., latches, and the like) to better assemble and/or disassemble the device 100. Indeed, as also depicted in FIG. 2, the housing 101 may include a top portion 127 (e.g. that includes the top surface 113) that may also be assembled with the remainder of the housing 101 to better assemble and/or disassemble the device 100. However, the combination of the housing 101 and the bezel 121 may be formed in any suitable manner, and/or the bezel 121 may form the housing 101 and/or the housing 101 may form the bezel 121, and the like.

In particular examples, the bezel 121 may be formed as part of the front surface 105 of the housing 101, the bezel 121 covering the cavity 103 and the one or more of the microphone 117 and/or a speaker, the bezel 121 having the outer face 123 coincident with the front surface 105 of the housing 101, and the inner face 125 facing the cavity 103.

The device 100 may further include other components and/or features, for example, as depicted, a push-to-talk (PTT) button 129, a cord 131 to a radio, and the like. Similarly, the bezel 121 may include other components, such as other buttons, and the like, for actuating and/or providing other functionality of the device 100 (e.g. volume buttons, headphone ports, toggle switches, and the like). However, the button 129, and the cord 131 are merely provided to adapt the device 100 for functionality as a wired RSM. However, the device 100 may include any suitable combination of features to adapt the device 100 for a particular functionality. For example, the device 100 may be adapted to function as a wireless RSM and may not include the cord 131. Similarly, the device 100 may be adapted to function as a wired and/or wireless microphone and/or speaker may not include the button 129 and/or the cord 131. Similarly, the device 100 may be adapted to function as a cell phone, and the like, and may include a display screen and input devices, and the like. However, any combination of other components and/or features for adapting the device 100 for a particular functionality are within the scope of the present specification.

Similarly, while the bezel 121 is provided as covering a substantial portion of the device 100 at the front surface 105 of the housing 101, the bezel 121 may be of a size and shape that is generally covering the cavity 103, with a remaining front surface 105 of the housing 101 provided as a separate component, and the like. Put another way, the bezel 121 may be of any suitable size and shape and/or may be integrated with the housing 101, and further may, or may not, be removable.

As depicted, the device 100 and/or the housing 101 and/or the bezel 121 may be of a length (e.g. between the surfaces 113, 115) that is longer than a width thereof (e.g. between the surfaces 109, 111). Furthermore, the device 100 and/or the housing 101 and/or the bezel 121 may be used in an upright position in "normal" operation thereof. For example, the upright position is depicted in FIG. 1, with the top surface 113 being upright and/or in a top position, relative to the bottom surface 115 (and/or relative to the ground and/or a floor (e.g. of a street, a room, the earth, etc.)). Hence, as best seen in FIG. 1 and FIG. 2, the device 100 and/or the housing 101 and/or the bezel 121 may include an upright axis 135 that extends between, and/or through, and/or about perpendicular to, the surfaces 113, 115. The axis 135 may be interchangeably referred to as a longitudinal axis as the axis 135 also extends long the length of the device 100 and/or the axis 135 is about perpendicular to the shorter width. Put another way, the bezel 121 comprises a top edge 137 (and/or a first outer edge 137) and an opposing bottom edge 139 (and/or a second outer edge 139), as best seen in FIG. 3, and the axis 135 may extend between the top edge 137 and the bottom edge 139 of the bezel 121 (and/or the axis 135 may be perpendicular to the top edge 137 and the bottom edge 139).

Water drainage features of the device 100 are next described in combination with features for enabling sound waves to pass between the outer face 123 of the bezel 121 and the cavity 103.

In particular, the device 100 generally comprises linear slots 141-1, 141-2, 141-3 through the bezel 121 from the outer face 123 to the inner face 125, the linear slots 141-1, 141-2, 141-3 being obliquely angled relative to the upright axis 135 of the bezel 121 (and/or the device 100 and/or the housing 101). The linear slots 141-1, 141-2, 141-3 are interchangeably referred to hereafter, collectively, as the linear slots 141 and, generically, as a linear slot 141. This notation will be used elsewhere in the present specification. Furthermore, for simplicity only one linear slot 141 is indicated in FIG. 1.

In general, the linear slots 141 comprise apertures and/or ports (e.g. microphone ports and/or speaker ports) to allow sound to pass between the outer face 123 of the bezel 121 and the cavity 103 and/or the microphone 117. In particular, as best seen in FIG. 2, the device 100 includes a direct air path 142 between the linear slots 141 and the cavity 103 and/or the one or more of the microphone 117 and a speaker; for example, the direct air path 142 excludes a grille and/or a sneak path, providing for better passage of sound between the linear slots 141 and the cavity 103, etc. (e.g. as compared to prior art devices that include a grille and/or sneak path).

The linear slots 141 are referred to as "linear" as they have a respective length which is longer than a respective width. As will be described hereafter, such a configuration assists with drainage of water which accumulates at the linear slots 141 and/or a capillary effect which may assist with formation of water droplets in the linear slots 141.

Furthermore, the linear slots 141 are obliquely angled relative to the upright axis 135 and/or the linear slots 141 are obliquely angled relative to the first side surface 109 and the second side surface 111 of the housing 101, and/or relative to the top surface 113 and the bottom surface 115 of the housing 101. In general, the oblique angle of the linear slots, which may be in range of about 45° to 55° and/or any other suitable angle (e.g. in a range of about 20° to about 80°), assist with drainage water at the linear slots 141 when the device 100 is upright (e.g. with the top side surface 113 being in an upright position), upside down (e.g. with the bottom side surface 115 being in an upright position) and/or when the device 100 is sideways (e.g. with the left side surface 109 or the right side surface 111 being in an upright position). In other words, the angle of the linear slots 141, relative to the upright axis 135 and/or the first side surface 109 and/or the second side surface 111 and/or the top surface 113 and/or the bottom surface 115, is selected such that gravitational pull occurs on water at the linear slots 141 when the device 100 is upright, upside down or sideways.

Put yet another way, with reference to FIG. 3, the linear slots 141 may obliquely extend between respective first ends 143 and respective second ends 145, the respective first ends 143 located adjacent an outer edge of the bezel 121, in particular, as depicted, the respective first ends 143 are located adjacent the top edge 137 of the bezel 121. While only one first end 143 and one second end 145 are numbered in FIG. 3 for simplicity, it is understood that the linear slots 141 each include similar respective ends 143, 145.

While only three linear slots 141 are included at the device 100, the device 100 may include any suitable number of linear slots 141 including as few as one linear slot 141 and/or more than three linear slots 141.

Furthermore, while the linear slots 141 are depicted as being about parallel to each other, the linear slots 141 may be in any suitable arrangement.

As depicted, the device 100 further comprises linear slats 147-1, 147-2 (e.g. linear slats 147 and/or a linear slat 147) separating the linear slots 141 at the bezel 121 and forming sides of the linear slots 141, described in more detail below with respect to FIG. 4 and FIG. 5. In general, however, the dimensions of the linear slats 147 and/or the sides of the linear slots 141 (including, but not limited to, a thickness of the linear slats 147) are selected to have dimensions that promote formation of water droplets thereon, of a size which overcome water surface tension and flow out of the linear slots 141 when the bezel 121 is exposed to one or more of mist, rain, water and humidity.

Put another way, at least the sides of the linear slots 141 (e.g. formed by the linear slats 147) provide a platform for formation of water droplets, which may be assisted by a capillary effect, when the bezel 121 is exposed to one or more of mist, rain, water and humidity, and the linear slots 141 further provide for the removal of the water droplets when a surface tension of the water droplets formed on the platform is reached, which may be assisted by a capillary action in the linear slots 141. In general, sides of the linear slots 141, between the ends 143, 145 (e.g. along a long dimension of the linear slots 141), separated by the linear slats 147, are formed by a thickness of the linear slats 147.

The number of linear slats 147 generally depends on a number of the linear slots 141 which the linear slats 147 separate. For example, as depicted, as there are three linear slots 141, the device 100 comprises two linear slats 147 (e.g. a linear slat 147-1 between linear slots 141-1, 141-2, and a linear slat 147-2 between linear slots 141-2, 141-3). However, the number of linear slats 147 may be more than two or fewer than two depending on the number of linear slots 141.

In examples, when the device 100 comprises one linear slot 141, the device 100 may be absent the linear slats 147. In these examples, sides of the one linear slot 141 are formed by a thickness between the outer face 123 and the inner face 125 of the bezel 121, and hence the platform for the water droplets formed by the sides are formed by a thickness between the outer face 123 and the inner face 125 of the bezel 121.

Put another way, the device 100 may comprise one or more linear slots 141 through the bezel 121 from the outer face 123 to the inner face 125, the one or more linear slots 141 having sides providing a platform for formation of water droplets, which may be assisted by a capillary effect, when the bezel 121 is exposed to one or more of mist, rain, water and humidity, the linear slots 141 providing for the removal of the water droplets when a surface tension of the water droplets formed on the platform is reached. The platform may generally be provided by the sides of the one or more linear slots 141 and/or the platform may generally be provided at the sides of the one or more linear slots 141.

Similarly, as depicted, the linear slots 141 include a first linear slot 141-1 and a last linear slot 141-3 (e.g. in a row of the linear slots 141), and respective outer sides of the first linear slot 141-1 and the last linear slot 141-3 that are not formed by the linear slats 147 (but rather are formed by formed by adjacent regions of the bezel 121) are one or more of a same thickness or a similar thickness as a thickness of the linear slats 147 which otherwise separate the linear slots 141. However, in some examples, the outer sides of the first linear slot 141-1 and the last linear slot 141-3, that are not formed by the linear slats 147, may be of a smaller thickness than the linear slats 147.

Hence, in general, sides of the linear slots 141, between the ends 143, 145 along a long dimension of the linear slots 141, have dimensions and/or a thickness selected to promote formation of water droplets thereon of a size which overcome water surface tension and flow out of the linear slots 141 when the bezel 121 is exposed to one or more of mist, rain, water and humidity. Put another way, sides of the linear slots 141, between the ends 143, 145 along a long dimension of the linear slots 141, have dimensions and/or a thickness selected to provide a platform for formation of water droplets, which may be assisted by a capillary effect, when the bezel 121 is exposed to one or more of mist, rain, water and humidity, the linear slots 141 providing for the removal of the water droplets when a surface tension of the water droplets formed on the platform is reached.

As best seen in FIG. 2, the outer face 123 of the bezel 121 may be chamfered around the linear slots 141. However, sides of a linear slot 141, between the ends 143, 145, along a long dimension of the linear slots 141, and which face each other in a linear slot 141 may be parallel to each other, other than at the ends 143, 145 where, as depicted, the sides are joined. While as depicted, at the ends 143, 145, sides of a linear slot 141, which face each other, are joined at the ends 143, 145 via a curve (e.g. the ends 143, 145 may be rounded), in other examples sides of a linear slot 141, which face each other, are joined at the ends 143, 145 via any suitable shape and/or structure.

The linear slats 147 are generally referred to "linear" for similar reasons as the linear slots 141, as the linear slats 147 are generally longer than they are wider, similar to the linear slots 141.

Comparing FIG. 3 with FIG. 1 and FIG. 2, in the depicted example, the outer surface 123 of the bezel further includes additional ornamental regions 150 which externally "look" like the slots 141, but are provided merely for aesthetic purposes; for example, such ornamental regions 150 are not visible at the inner surface 125 depicted in FIG. 3.

As best seen in FIG. 3, the device 100 further comprises one or more recesses 151-1, 151-2, 151-3, 151-4 (e.g. the recesses 151 and/or a recess 151) at the inner face 125 of the bezel 121, adjacent to the linear slots 141, the one or more recesses 151 to collect water from the water droplets as the water flows out of the linear slots 141.

For example, as depicted, the one or more recesses 151 include: at least one recess 151-1 adjacent the respective second ends 145 to collect the water from the water droplets as it flow outs of the linear slots 141 when the device 100 is in an upright position. Indeed, the recess 151-1 may be a primary recess 151 as the device 100 may "normally" be operated in the upright position, and hence the recess 151-1 may collect the most water as compared to the other recesses 151.

However, as depicted, the one or more recesses 151 include: at least one recess 151-2 located between the respective first ends 143 and the outer edge 137 of the bezel 121, at least one recess 151-2 extending along the outer edge 137 in an elongated shape, at least as compared to the at least one recess 151-1. The at least one recess 151-2 is to collect the water from the water droplets as it flow outs of the linear slots 141 when the device 100 is in an upside down position. Hence, when the device 100 is inverted from the upright position, water may flow from the linear slots 141 to the at least one recess 151-2.

As depicted, the one or more recesses 151 include one or more recesses 151-3, 151-4 located adjacent one or more of: the first linear slot 141-1 and the last linear slot 141-2 to collect the water from the water droplets as it flow outs of the linear slots 141 when the device 100 is in a sideways position. Hence, when the device 100 is rotated about 90° from the upright position, for example also rotating the axis 135 (e.g. which is different from rotating around the device 100 around the axis 135), water may flow from the linear slots 141 to the recess 151-3, or the recess 151-4 depending on a direction of rotation.

Put another way, a recess 151, which is in a downwards-most position, generally receives water from the linear slots 141.

In general, a volume of the one or more recesses 151 is selected to accumulate water from the water droplets as the water flows and/or drains out of the linear slots 141. The respective volumes of the recesses 151 may be similar and/or the same, and/or respective volumes of the recesses 151 may be different from one another.

Furthermore a shape and/or depth of the recesses 151 may depend on a position thereof at the inner face 125 and/or dimensions of the inner face 125 and/or features of the inner face 125. For example, the recess 151-1, which is depicted in cross-section in FIG. 6, may generally be rectangular in cross-section and/or box-shaped and have a depth into the inner face 125 that is deeper than the other recesses 151-2, 151-3, 151-4. Furthermore, while one recess 151-1 is depicted, the recess 151-1 may be provided as a plurality of recesses (e.g. for each of the linear slots 141 and/or a recess 151 for two of the linear slots 141 but not all of the linear slots).

The shape of the recess 151-2 is further elongated along the top edge 137 of the bezel 121 for example, to encompass a volume similar to the volume of the recess 151-1. In other words, as at the top edge 137 the bezel 121 includes other features such as a lip and/or rim, there may be less room in which to fit a volume of the recess 151-2, and hence the recess 151-2 collects water in a main space adjacent the linear slots 141, and the water may flow into the elongated space along the top edge 137.

In contrast to the recesses 151-1, 151-2, the recesses 151-3, 151-4 are generally flat and/or have a smaller depth, and area of the recesses 151-3, 151-4 is larger than respective area of the recesses 151-1, 151-2, for example to provide a respective volume of the recesses 151-3, 151-4 that is similar to a respective volume of the recesses 151-1, 151-2.

As also best seen in FIG. 3, the device 100 may further comprise at least one drainage channel 153-1, 153-2, 153-3, 153-4, 153-5, 153-6 (e.g. channels 153 and/or a channel 153) out of the one or more recesses 151 to enable water in the one or more recesses to drain out of the device 100 (e.g. from the one or more recesses 151).

For example, as depicted, the channel 153-1 comprises a slit and/or an aperture through the bezel 121, between the recess 151-1 (and/or adjacent the recess 151-1) at the inner face 125 and the outer face 123. The remaining channels 153-2, 153-3, 153-4, 153-5, 153-6 comprise paths and/or grooves, and the like, at the inner face 125 from a recess 151 to edges of the bezel 121. The various channels 153-2, 153-3, 153-4, 153-5, 153-6 are to "left" and/or "right" edges (e.g. relative to the top edge 137 as depicted in FIG. 3) of the bezel 121 and/or the top edge 137 of the bezel 121, for example to allow water to drain out of the recesses 151 when the device 100 is upright, upside down or sideways.

Furthermore, as also depicted in FIG. 3, the device 100 may comprise a ridge 160 which may reside against a complimentary inner portion 161 of the device 100 (e.g. as depicted in FIG. 2) which may be around an aperture 162 in the inner portion under the bezel 121 that provides access to an interior of the device 100 when the bezel 121 is removed, the ridge 160 to prevent water that may leak out of the one or more recesses 151 from entering the interior of the device 100. As depicted the ridge 160, and the inner portion 161 of the device 100 against which the ridge 160 resides and/or mates and/or interfaces (e.g. when the device 100 is assembled), are circular (e.g. as is the aperture 162), however the ridge 160 and the inner portion 161 (e.g. and/or the aperture 162) may be any suitable respective shapes.

Figure 4:
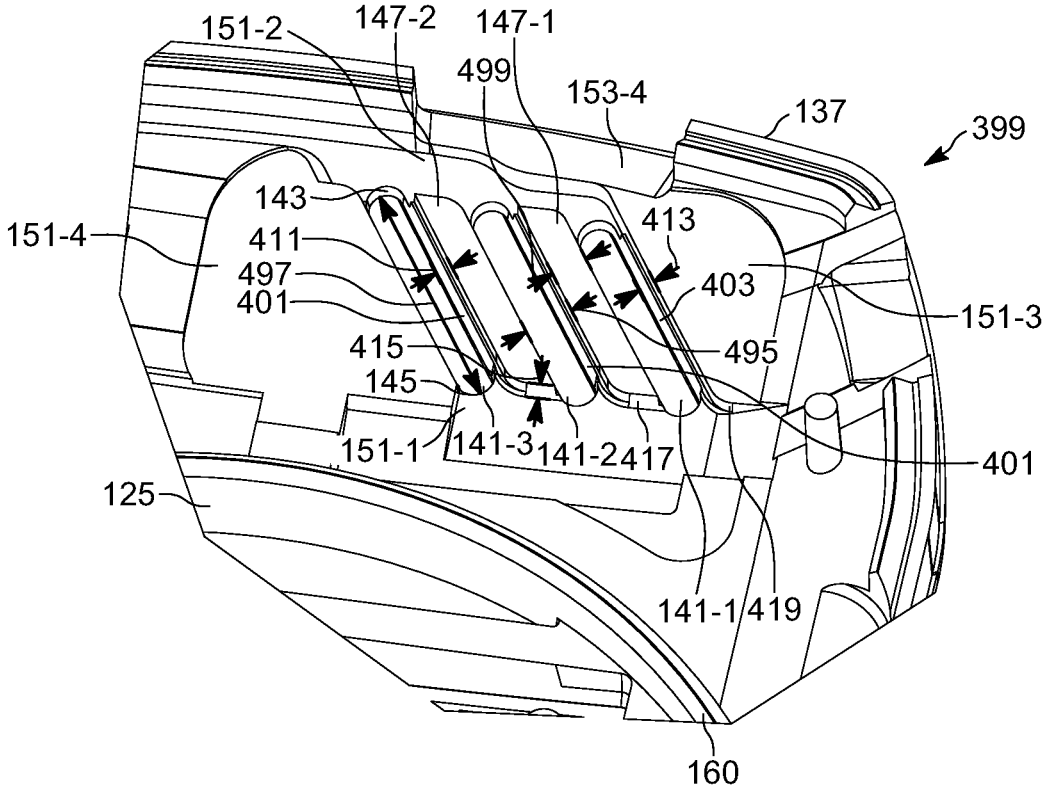
FIG. 4 depicts a perspective view of detail of a region of the inner face of the bezel shown in FIG. 3, in accordance with some examples.

Attention is next directed to FIG. 4 which depicts a perspective view of detail of a region 399 of the inner face 125 of the bezel 121 (e.g. the region 399 indicated in FIG. 3), the region 399 including the linear slots 141 and the linear slats 147.

Furthermore, the perspective shown in FIG. 4 shows a thickness of the linear slats 147 and/or sides 401 of the linear slots 141 formed by the linear slats 147, as well as a thickness of outer sides 403 of the linear slots 141-1, 141-3 that are not formed by the linear slats 147.

For example, as depicted, the sides 401 of the linear slots 141 formed by the linear slats 147 have a thickness 411, and outer sides 403 of the linear slots 141-1, 141-3 that are not formed by the linear slats 147 have a thickness 413.

In general, the thicknesses 411, 413 (e.g. including a thickness of the linear slats 147) are selected to form water droplets of a size which overcome water surface tension and flow out of the linear slots 141 (e.g. into at least one recess 151) due at least in part to gravitational pull on the water droplets, as described in more detail below.

Put another way, the thicknesses 411, 413 (e.g. including a thickness dimension of the linear slats 147) are selected to form water droplets of a size which overcome water surface tension and flow out of the linear slots 141, which may be due, at least in part, to inducing a capillary action on the water droplets.

In some examples, as depicted, the thickness 413 of the respective outer sides 403 of the first linear slot 141-1 and the last linear slot 143-3 are one or more of a same thickness dimension or a similar thickness dimension as the thickness 411 of sides 401 of the linear slats 147.

While dimensions of the thicknesses 411, 413 may vary, the dimensions may also be constant and/or about constant (e.g. as depicted).

In some examples, the thicknesses 411, 413 (e.g. including a thickness dimension of the linear slats 147) may be in a range of about 1.0 mm to about 2.5 mm. In a particular example, the thicknesses 411, 413 may be about 1.8 mm.

However the dimensions of the thicknesses 411, 413 may be further selected in combination with selection of a width 495 of the linear slots 141 such that water droplets form at, and/or between, the sides 401, 403. For example, a capillary effect in a space may depend on a cross-sectional area of a space hence the thicknesses 411, 413 and the width 495 of the linear slots 141 may be selected such that an area of the linear slots (e.g. about the value of a thickness 411, 413 multiplied by a respective value for the width 495 of the linear slots 141) induces formation of water droplets, for example from side 401 to side 401 (and/or from side 401 to side 403) across a linear slot 141, the capillary effect holding the water droplets in place until a weight thereof breaks the water surface tension and water from the water droplets flow into a recess 151 (e.g. due to gravitational pull and/or capillary action which may also be affected by the thicknesses 411, 413 and/or the width 495). Such formation of water droplets and/or flow of water (e.g. due to gravitational pull and/or capillary action) may further be affected by a material that forms the sides 401, 403 (e.g. and the bezel 121) hence, the thicknesses 411, 413 may be further selected in combination with selection of a width 495 of the linear slots 141 a given surface energy of the material of the material that forms the sides 401, 403 (e.g. and the bezel 121). For example, the bezel 121 may be formed from a polycarbonate material (and/or any other suitable material), with the thicknesses 411, 413 and the width 495 of the linear slots 141 selected accordingly.

In the particular example where the thicknesses 411, 413 may be about 1.8 mm, the linear slots 141 may be about 0.9 mm wide and/or at least 0.9 mm wide (e.g. between a first side 401 to an opposing second side 401, and/or between an inner side 401 to an opposing outer side 403), for example when the bezel 121 is formed from polycarbonate material. However, in general, the linear slots 141 may be less than about 2 mm wide, and/or width 495 of the slots 141 may be in a range of about 0.9 to about 2 mm, and which may also depend on the material of the bezel 121.

It is further understood, however, that the thicknesses 411, 413 and the width 495 of the linear slots 141 may be determined heuristically and/or through trial and error.

Also depicted in FIG. 4 is a thickness 415 of the linear slats 147 adjacent reigns of the inner face 125 of the bezel 121 that do not form the sides 401 (e.g. at ends 417 of the linear slats 147). The depicted thickness 415, for example, is at the recess 151-1. From FIG. 4, it is understood that the linear slats 147 may be raised relative to adjacent regions of the inner face 125 of the bezel 121. Water droplets may also form at a ridge formed by the thickness 415. It is understood that the thickness 415 may represent an increase in thickness of the sides 401 (e.g. and the sides 403) over prior art devices where sides are not as thick as the sides 401, 403 of the device 100; put another way, prior art devices may have slots where sides have thicknesses are reduced by at least the thickness 415. Hence, the increased thickness 415 assists with water droplet formation, described in more detail below. For example, the thickness 415 may be about 0.8 mm thick, however the thickness 415 may be any suitable value and/or in any suitable range (e.g. selected in combination with the thicknesses 411, 413, the width 495 of the linear slots 141, a given surface energy of the material of the material that forms the sides 401, 403, and the like).

Furthermore, as depicted, the ends 417 may be rounded and/or partially rounded, to promote flow of water from water droplets at the sides 401 into a recess 151. However, the ends 417 may be any suitable shape. Similarly, portions 419 of the sides 403 may be rounded to promote flow of water from water droplets at the sides 403 into a recess 151.

While a length 497 of the linear slots 141 (e.g. between the ends 143, 145) may be less critical to formation of water droplets, the length 497 of the linear slots 141, in combination with the width 495 of the linear slots 141, may be selected to reduce to reduce Helmholtz resonance within a given transmission band. For example, Helmholtz resonance may be induced at the linear slots 141 and the cavity 103 due to wind blowing across the linear slots 141, according to the following Equation (1):

$$F=v/(2\pi)*(A/(Vt))^{0.5} \qquad \text{Equation (1)}$$

In Equation (1), F is a resonance frequency, v is the velocity of sound, Vis a volume of the cavity 103, A is an area of a linear slot 141 (e.g. about length 497 of a linear slot 141 multiplied by a width 495 of a linear slot 141), and t is a thickness 411, 413 of a side 401, 403. As such, the thicknesses 411, 413, and the widths 495 of the linear slots 141 may be selected to promote formation of water droplets at the sides 401, 403, while the length 497 of the linear slots 141 may be selected to induce a particular resonance frequency F. However, the thicknesses 411, 413, and the areas of the linear slots 141 (including both the width 495 and length 497 of the linear slots 141) may be selected both to promote formation of water droplets at the sides 401, 403 and to induce a particular resonance frequency F and/or heuristically, etc.

Hence, for example, when the cavity 103 has a given volume, V, a thickness 411, 413 of the linear slats 147 and an area of the linear slots 141 may be further selected (e.g. in addition to selection thereof to promote formation of water droplets) to reduce Helmholtz resonance within a given transmission band, in combination with the given volume V. In some examples, the thickness 411, 413 of the linear slats 147 and an area of the linear slots 141 may be selected to reduce Helmholtz resonance below about 10000 Hz (e.g. at an upper end of frequency range of audio transmissions of the microphone 117 and/or a speaker) and/or such that the frequency F in Equation (1) is above about 6000 Hz, and/or above about 3000 Hz.

In particular examples, a width 495 of the linear slots 141 may be about 0.9 mm, and the length 497 of the linear slots 141 (e.g. between the ends 143, 145) may be in a range of about 8 mm to about 9 mm (e.g. in a particular example about 8.3 mm) and/or any other suitable length compatible, for example, with Equation (1) and/or a volume and/or size of the cavity 103.

A width 499 of the linear slats 147 is also seen in FIG. 4 (e.g. a distance between sides 401 of adjacent linear slots 141). In some examples, as depicted, the width 499 of the linear slats 147 may be at least a respective width 495 of the linear slots 141, however the width 499 of the linear slats 147 may smaller or larger than the respective width 495 of the linear slots 141.

Also depicted in FIG. 4 are details of the channel 153-4 at the top edge 137. As depicted, the channel 153-4 comprises an aperture through the top edge 137 connected to the recesses 151-2, 151-3, to drain water from the recesses 151-2, 151-3.

Water droplet formation at the sides 401, 403 is next described with reference to FIG. 5 and FIG. 6. FIG. 5 depicts a planar view of the region 399, while FIG. 6 depicts a cross-sectional view of the region 399 through the line A-A depicted in FIG. 5.

Figure 5:
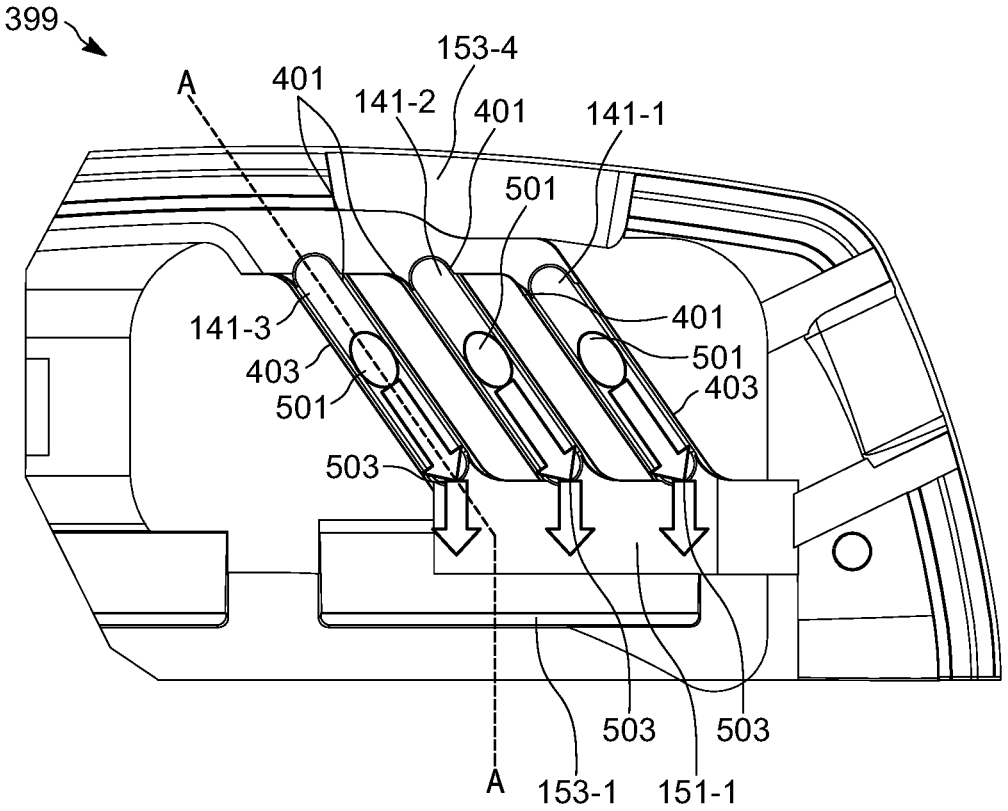
FIG. 5 depicts a planar view of detail of a region of the inner face of the bezel shown in FIG. 3, in accordance with some examples.
Figure 6:
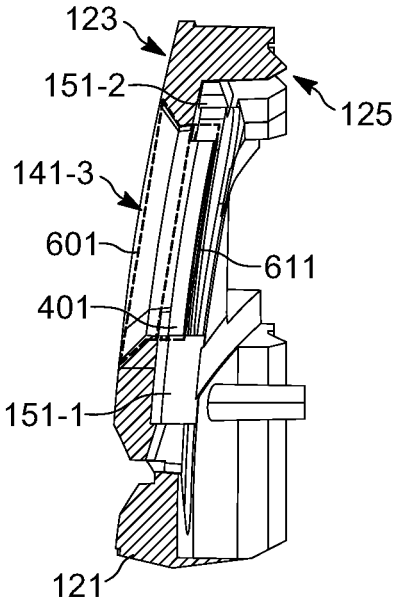
FIG. 6 depicts a cross-section through a line A-A of FIG. 5, in accordance with some examples Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

In particular, in FIG. 5, the device 100 and/or the bezel 121 may have been subjected to mist, rain, water and humidity, in a test environment and/or in a real world environment. For example, when testing devices for water drainage, devices may be subjected to a mist test, a water dunk test, and the like.

Regardless, in FIG. 5, water droplets 501 have formed across each of the linear slots 141 (e.g. from side 401 to side 403 at the linear slots 141-1, 141-3, and from side 401 to side 403 at the linear slot 141-2). The water droplets 501 form at the sides 401, 403, and promotion formation of the water droplets 501 at the sides 401, 403 may occur at least in part due to the thickness 411, 413 (e.g. increased by the thickness 415 as compared to prior art devices) of the sides 401, 403, and may hold their shape due to surface tension of water (and surface energy of a material of the sides 401, 403), and a size of the water droplets at the sides 401, 403.

As the water droplets 501 are subjected to more mist, rain, water and humidity, and the like, a size of the water droplets 501 grow and generally reach a size that bridges a width 495 of the linear slots 141 (e.g. as depicted); the capillary effect may hold the water droplets 501 in the linear slots 141. As the water droplets 501 continue to grow, the water droplets 501 reach a size where gravitational pull on the water droplets 501 cause the water droplets 501 to overcome water surface tension and "break" flowing down a linear slot 141 into a recess 151; for example, as depicted in FIG. 4, water from the water droplets 501 may flow into the recess 151-1, via a respective linear slot 141, as represented the arrows 503. Such flow may also be due to an induced capillary action and/or capillary flow of water in the linear slots 141. For the example, the slots 141 may "wick" water from the water droplets 501 out of the linear slots 141 due to capillary action. While a meniscus of the water droplets 501 is depicted as a convex meniscus in the linear slots 141, in other examples the water droplets 501 may have a concave meniscus in the linear slots 141, depending on a surface energy of the material of the sides 401, 403.

The water may collect in the recess 151-1 until further gravitational pull on the water causes the water to flow out of the channel 153-1. A similar action occurs when the device 100 is upside down, though water from the water droplets 501 may flow into the recess 151-2 and out the channel 153-4. A similar action occurs when the device 100 is sideways, though water from the water droplets 501 may flow into the recess 151-3 or the recess 151-4 and out the channels 153-2, 153-3, 153-5, 153-6.

In some examples, the water droplets 501 may "break" before bridging the width 495 of the linear slots 141, depending, for example, on the width 495 of the slots 141, a dimension of the thicknesses 411, 413, and the like.

Attention is next directed to FIG. 6 which depicts the cross-section through the line A-A of FIG. 5. In particular, a cross-section of the linear slot 141-3, the recess 151-1 and the recess 151-2 are depicted, as well as a side 401 of the linear slot 141-3.

FIG. 6 shows that the recess 151-1 is rectangular in cross-section, though the recess 151-1 may be any suitable shape.

In particular, FIG. 6 shows regions 601, 611 at which water that forms the water droplets 501 may collect. The region 601 indicates surfaces at which water collects without increased thickness 415 of the side 401 (e.g. as described above), which also includes a chamfered portion of the outer face 123 of the bezel 121. In contrast, the region 611 indicates the additional surfaces of the side 401 due to the thickness 415 (e.g. added to the region 601) at which water collects, which both increases surface area on which the water droplets 501 form (e.g. relative to the region 601) and increases the cross-sectional area of the linear slots 141 (e.g. to which can lead to an increased capillary effect (e.g. relative to when only the surfaces of the region 601 are present, as in prior art devices)). Indeed, FIG. 6 further illustrates that while examples of the capillary effect and Helmholtz resonance have been described above only with reference to the thicknesses 411, 413, and the width 495 of the linear slots 141, capillary effect and Helmholtz resonance may also be influenced by the chamfered portion of the outer face 123 of the bezel 121.

In the foregoing specification, specific embodiments have been described. However, one of ordinary skill in the art appreciates that various modifications and changes may be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

In this document, language of "at least one of X, Y, and Z" and "one or more of X, Y and Z" may be construed as X only, Y only, Z only, or any combination of two or more items X, Y, and Z (e.g., XYZ, XY, YZ, XZ, and the like). Similar logic may be applied for two or more items in any occurrence of "at least one . . . " and "one or more . . . " language.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment may be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it may be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A device comprising:

a cavity;

one or more of a microphone and a speaker mounted in the cavity;

a bezel covering the cavity and the one or more of the microphone and the speaker, the bezel having an outer face and an inner face, the inner face facing the cavity;

linear slots through the bezel from the outer face to the inner face, the linear slots being obliquely angled relative to an upright axis of the bezel, the linear slots having a long dimension between respective first ends and respective second ends of the linear slots;

linear slats separating the linear slots at the bezel and forming sides thereof, the sides of the linear slats sides, between the respective first ends and the respective second ends, along the long dimension of the linear slots, facing each other and having dimensions selected to promote formation of water droplets thereon of a size which overcome water surface tension and flow out of the linear slots when the bezel is exposed to one or more of mist, rain, water and humidity, a thickness of the linear slats selected to form the water droplets of the size which overcome the water surface tension and flow out of the linear slots due at least in part to inducing a capillary effect on the water droplets; and one or more recesses at the inner face of the bezel, adjacent to the linear slots, the one or more recesses to collect water from the water droplets as the water flows out of the linear slots.

2. The device of claim 1, wherein the cavity has a given volume, and the thickness of the linear slats and an area of the linear slots are further selected to reduce Helmholtz resonance within a given transmission band, in combination with the given volume.

3. The device of claim 1, wherein the thickness of the linear slats is selected to form the water droplets of the size which overcome the water surface tension and flow out of the linear slots due at least in part to gravitational pull on the water droplets.

4. The device of claim 1, wherein respective outer sides of a first linear slot and a last linear slot are one or more of a same thickness or a similar thickness as a thickness of the linear slats.

5. The device of claim 1, wherein the linear slats are raised relative to adjacent regions of the inner face of the bezel.

6. The device of claim 1, further comprising a direct air path between the linear slots and the cavity, wherein the direct air path excludes a grille.

7. The device of claim 1, further comprising at least one drainage channel out of the one or more recesses to enable water in the one or more recesses to drain.

8. The device of claim 1, wherein the upright axis of the bezel extends between a top edge and a bottom edge of the bezel.

9. The device of claim 1, wherein the linear slots obliquely extend between respective first ends and respective second ends, the respective first ends located adjacent an outer edge of the bezel, and the one or more recesses include: at least one recess adjacent the respective second ends to collect the water from the water droplets as the water flow outs of the linear slots when the device is in an upright position.

10. The device of claim 1, wherein the linear slots extend between respective first ends and respective second ends, the respective first ends located adjacent an outer edge of the bezel, and the one or more recesses include: at least one recess located between the respective first ends and the outer edge, at least one recess extending along the outer edge, to collect the water from the water droplets as the water flow outs of the linear slots when the device is in an upside down position.

11. The device of claim 1, wherein the linear slots include a first linear slot and a last linear slot, and the one or more recesses include: at least one recess located adjacent one or more of: the first linear slot and the last linear slot to collect the water from the water droplets as the water flow outs of the linear slots when the device is in a sideways position.

12. The device of claim 1, wherein a volume of the one or more recesses is selected to accumulate the water droplets.

13. The device of claim 1, wherein the outer face of the bezel is chamfered around the linear slots.

14. The device of claim 1, wherein a width of the linear slats is at least a respective width of the linear slots.

15. The device of claim 1, wherein the thickness of the linear slats is at least about 1.8 mm.

16. The device of claim 1, wherein the thickness of the linear slats is in a range of about 1.0 mm to about 2.5 mm.

17. The device of claim 1, wherein the linear slots are at least about 0.9 mm wide.

18. The device of claim 1, wherein the linear slots less than about 2 mm wide.

19. A portable communication device comprising:

a housing having a cavity formed therein, the housing having a front surface, a back surface, a first side surface and a second side surface, and a top surface and a bottom surface;

one or more of a microphone and a speaker mounted in the cavity;

a bezel formed as part of the front surface of the housing, the bezel covering the cavity and the one or more of the microphone and the speaker, the bezel having an outer face, coincident with the front surface of the housing, and an inner face, the inner face facing the cavity;

linear slots through the bezel from the outer face to the inner face, the linear slots being obliquely angled relative to the first side surface and the second side surface of the housing, and relative to the top surface and the bottom surface of the housing, the linear slots having a long dimension between respective first ends and respective second ends of the linear slots;

linear slats separating the linear slots at the bezel and forming sides thereof, at least the sides providing a platform for formation of water droplets when the bezel is exposed to one or more of mist, rain, water and humidity, the linear slots providing for removal of the water droplets when a surface tension of the water droplets formed on the platform is reached, wherein the sides of the linear slats sides, between the respective first ends and the respective second ends, along the long dimension of the linear slots, face each other, and a thickness of the linear slats is selected to form the water droplets of a size which overcome water surface tension and flow out of the linear slots due at least in part to inducing a capillary effect on the water droplets; and one or more recesses at the inner face of the bezel, adjacent to the linear slots, the one or more recesses to collect water from the water droplets as the water flows out of the linear slots.

* * * * *